United States Patent [19]

Sheppard

[11] Patent Number: 5,020,254

[45] Date of Patent: Jun. 4, 1991

[54] ILLUMINATED SIGN SYSTEM HAVING TENSIONING MEANS

[76] Inventor: Paul G. Sheppard, 17154 26A Avenue, Surrey, British Columbia, Canada, V4B 5E7

[21] Appl. No.: 184,110

[22] Filed: Apr. 20, 1988

[30] Foreign Application Priority Data

Feb. 9, 1988 [CA] Canada ..... 558490

[51] Int. Cl.[5] ..... G09F 17/00

[52] U.S. Cl. ..... 40/603; 40/574; 40/578; 160/378

[58] Field of Search ..... 40/603, 604, 574, 578; 160/378

[56] References Cited

U.S. PATENT DOCUMENTS

| | | | |
|---|---|---|---|
| 1,895,309 | 1/1933 | Boomershine | 160/378 |
| 2,533,565 | 12/1950 | Eichelman | 40/603 |
| 4,262,919 | 4/1981 | Krent | 280/16 |
| 4,265,039 | 5/1981 | Brooks | 40/603 |
| 4,317,302 | 3/1982 | Von De Linde | 40/603 |
| 4,452,000 | 6/1984 | Gandy | 40/603 |
| 4,542,605 | 9/1985 | Gandy | 40/603 |
| 4,674,213 | 6/1987 | Keithley | 40/603 |
| 4,747,441 | 5/1988 | Apolzer et al. | 160/84.1 |
| 4,771,559 | 9/1988 | Keithley | 40/603 |
| 4,833,805 | 5/1989 | Roberson | 40/603 |

FOREIGN PATENT DOCUMENTS

| | | | |
|---|---|---|---|
| 48408 | 8/1984 | Canada | 40/603 |

*Primary Examiner*—Kenneth J. Dorner
*Assistant Examiner*—James M. Gardner
*Attorney, Agent, or Firm*—Limbach, Limbach & Sutton

[57] ABSTRACT

An illuminated sign system which uses a flexible fabric face material has an improved system for tensioning the material. A tensioning bar is used which extends the full length of the sign face and holds the fabric material along one edge and uses the sign frame as a fulcrum along the other edge to draw the material tight. The sign system also includes a flexible hinge which acts as a seal to restrict the accumulation of water.

13 Claims, 4 Drawing Sheets

ILLUMINATED SIGN SYSTEM HAVING TENSIONING MEANS

BACKGROUND OF THE INVENTION

The present invention relates to illuminated sign systems, and more particularly to illuminated sign systems which utilize a flexible, stretchable fabric as a display face.

Traditionally illuminated outdoor signs have been constructed of rigid, translucent plastic panels mounted in a metal cabinet. The high costs involved in manufacturing, installing, maintaining and replacing the rigid plastic faces for large outdoor signs led to the development of illuminated outdoor signs which use a flexible, stretchable fabric as the display face. The fabric typically used is a polyvinyl chloride reinforced with glass fibres, which is translucent and can be stretched but is highly resistant to tearing. The flexible face material is well suited for the production of large colour designs by silk screening and is much easier to transport and install than the rigid plastic faces. It also has the advantage of being unbreakable.

One such sign system utilizing a stretchable fabric face is disclosed in U.S. Pat. No. 4,265,039 issued May 5, 1981 to ABC Extrusion Company. Other such sign systems are disclosed in U.S. Pat. Nos. 4,542,605 issued Sept. 24, 1985 and 4,452,000 issued June 5, 1984, both in the name of Signtech Inc. The system manufactured and sold by Signtech Inc. is sold under the trademark FLEXFACE. These sign systems have primarily two drawbacks. First, the tensioning systems in these existing sign systems require too many small parts, making the manufacture of the signs labour intensive and costly and making the signs difficult to repair in the field. For example, the FLEXFACE system requires that individual pieces called "flex holders" be installed every 10" along the material holding bar, and that "teeth clips" be clipped on to the bar between each "flex holder". This adds considerably to the number of pieces required and the length of time required to assemble the sign. It also makes tensioning of the sign face difficult in the field. Secondly, existing flexible face sign systems typically use a piano hinge to hinge the front face of the sign cabinet and allow the front face to be opened for maintenance. The structure of the existing systems is such that water can accumulate in recesses along the top of the sign. When the water freezes, the sign may be broken by an attempt to open the hinge.

There is therefore a need for an illuminated sign system having a flexible face material which is easy to assemble and tension and which has an improved hinge.

SUMMARY OF THE INVENTION

The present invention provides an illuminated sign system which uses a flexible face material in which the face material is easily and quickly installed and tensioned. The system comprises a continuous tension arm which is hinged to allow the entire length of the fabric to be tensioned uniformly. The system further comprises a flexible hinge construction in which the hinge device serves to both act as a hinge and to seal the hinge joint from water penetration.

BRIEF DESCRIPTION OF THE DRAWINGS

In drawings which illustrate a preferred embodiment of the invention.

DETAILED DESCRIPTION OF A PREFERRED EMBODIMENT OF THE INVENTION

Figure 1:
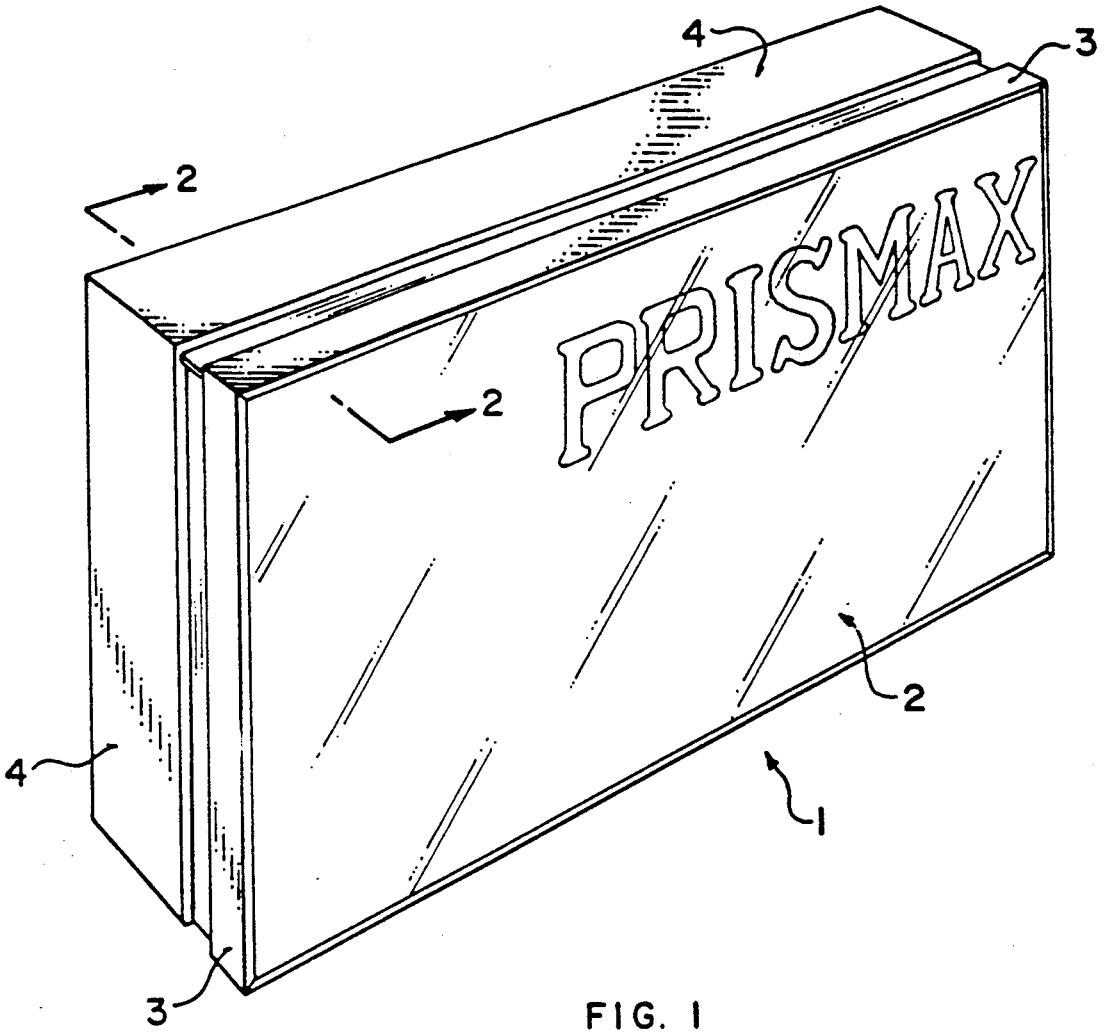
FIG. 1 is a perspective view of the sign system of the invention.
Figure 2:
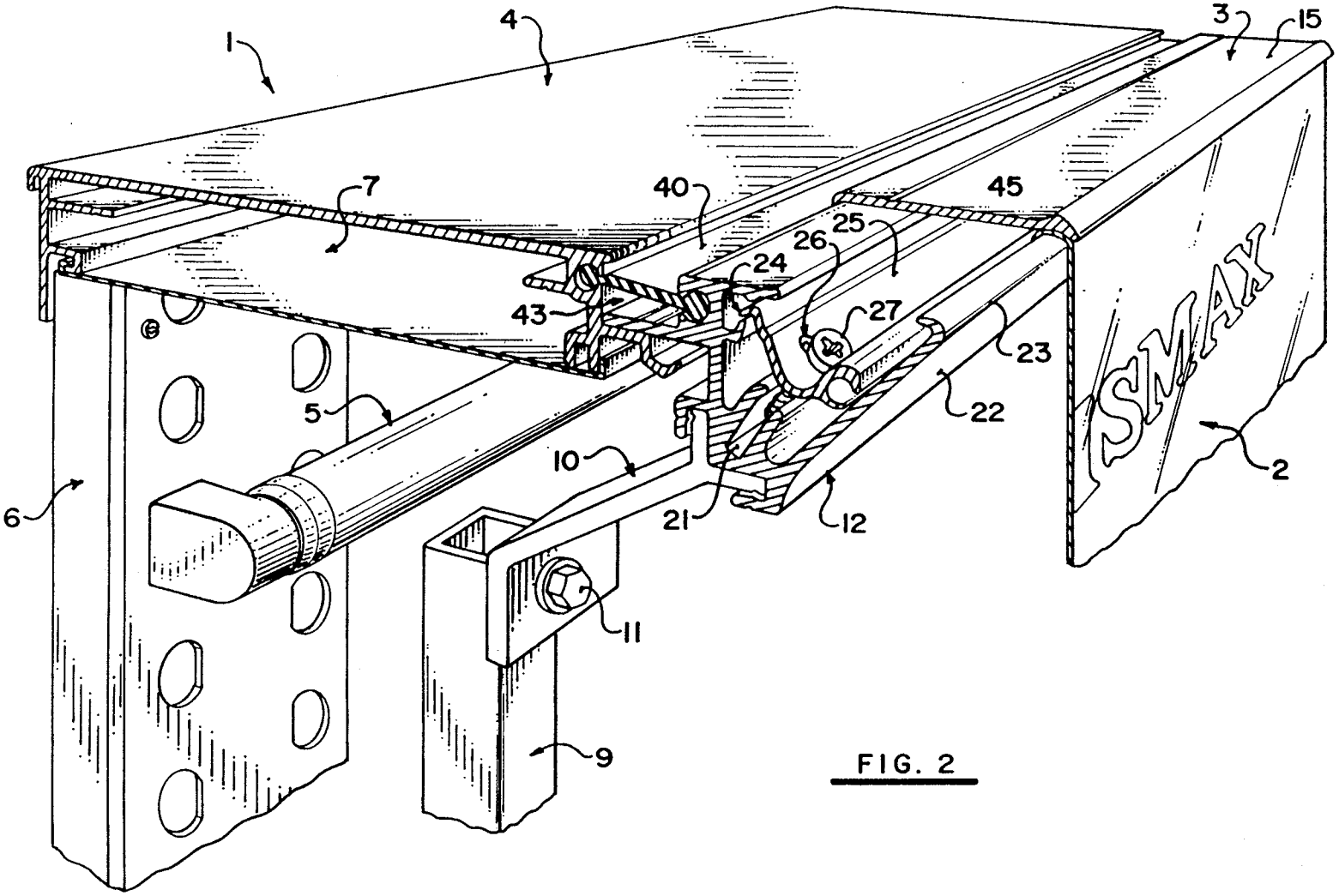
FIG. 2 is a perspective view partly in cross-section along Lines II—II of FIG. 1 and partly cut away shown in the interior of the sign system showing FIG. 1.

With reference to FIGS. 1 and 2, the sign system of the invention is designated generally as 1. It consists generally of a translucent sign face 2, sign frame 3 and filler 4. The sign face consists of a translucent, flexible vinyl material such as that sold under the trademark PRISMAX.

Within the body of the sign, as shown in FIG. 2, is mounted a fluorescent lamp 5. Raceways 6 and 7 are provided to carry the electrical wiring for the fluorescent lamps. A ballast 8, shown in FIG. 3, will also generally be required to power the fluorescent bulbs.

In order to provide rigidity to the cabinet without creating shadows on the sign face, spreader bars 9 are used which are set back from the sign face by means of spreader bracket 10. One end of the spreader bracket is secured to the spreader bar by bolt 11. The other end is Y-shaped to slide into the sign frame 12. In the single-faced cabinet, the back of the cabinet is provided with a metal sheet 13 and gussets 14 are used to reinforce the cabinet.

Figure 3B:
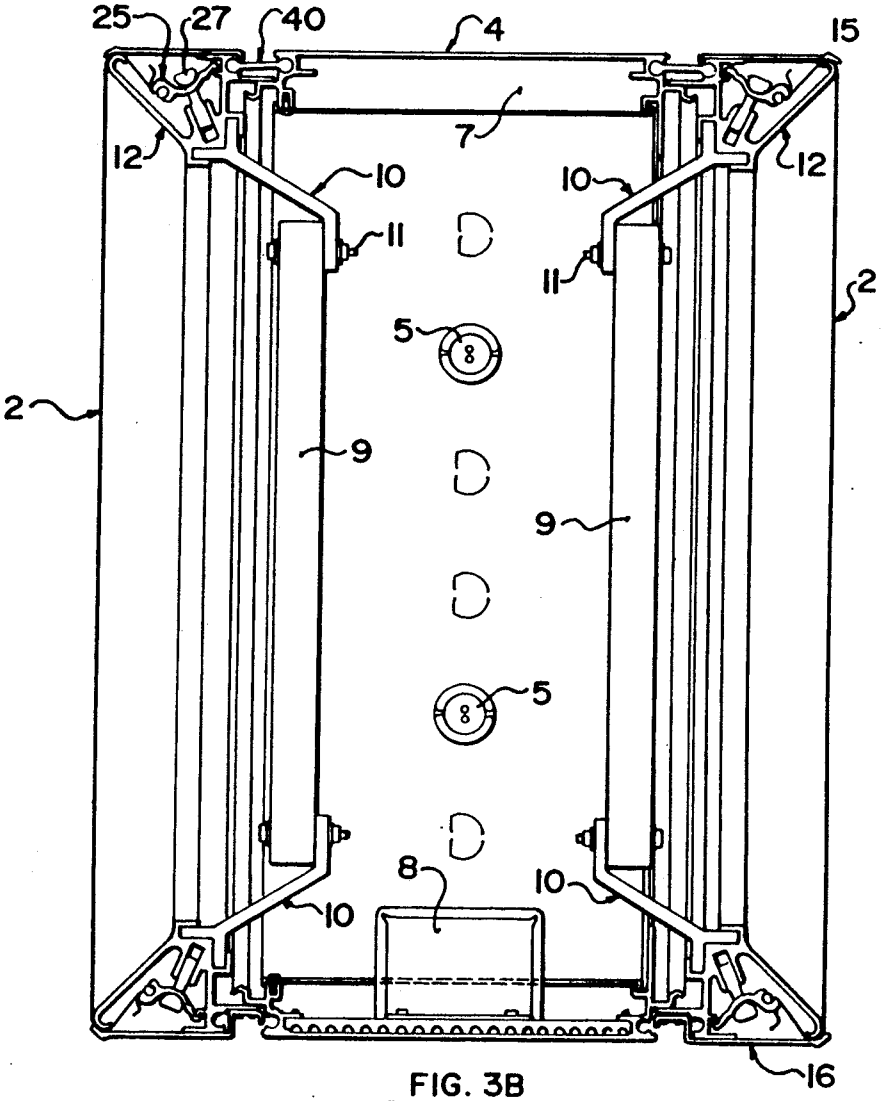
FIGS. 3*a* and 3*b* are cross-sectional views of single and double-face sign systems respectively of the type shown in FIG. 1.
Figure 3A:
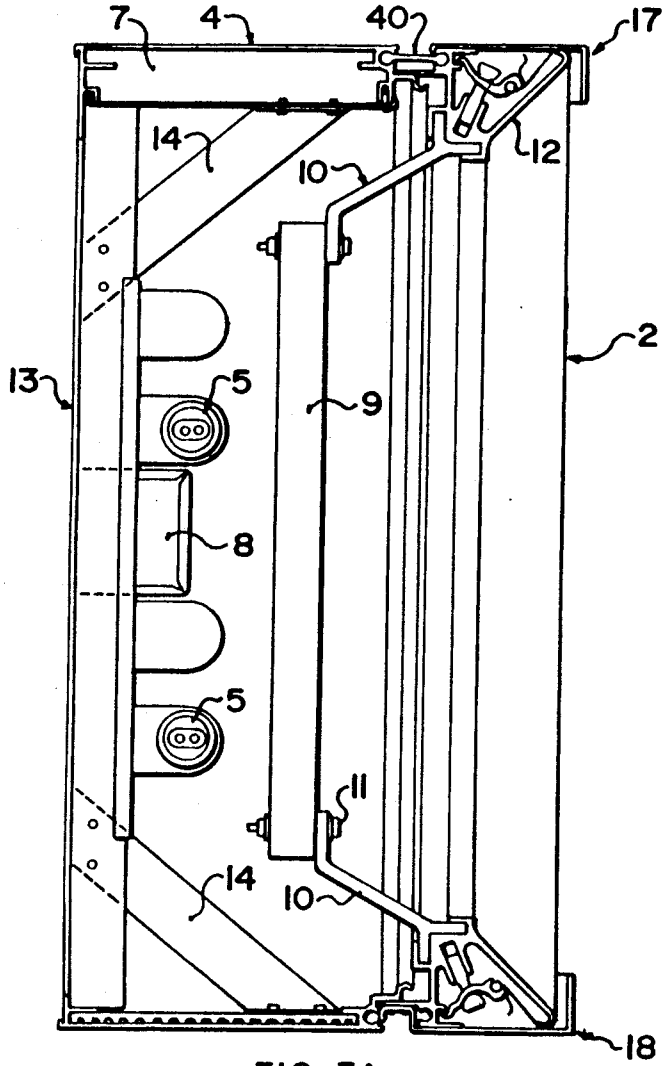

The double-faced cabinet is shown in FIG. 3*b*. FIGS. 2 and 3*b* show a frameless top cover 15 and bottom cover 16 which allows the maximum illuminated area for the sign face. FIG. 3*a* shows a top cover 17 and bottom cover 18 which are provided with a frame to give the sign face a more traditional framed appearance.

Figure 4:
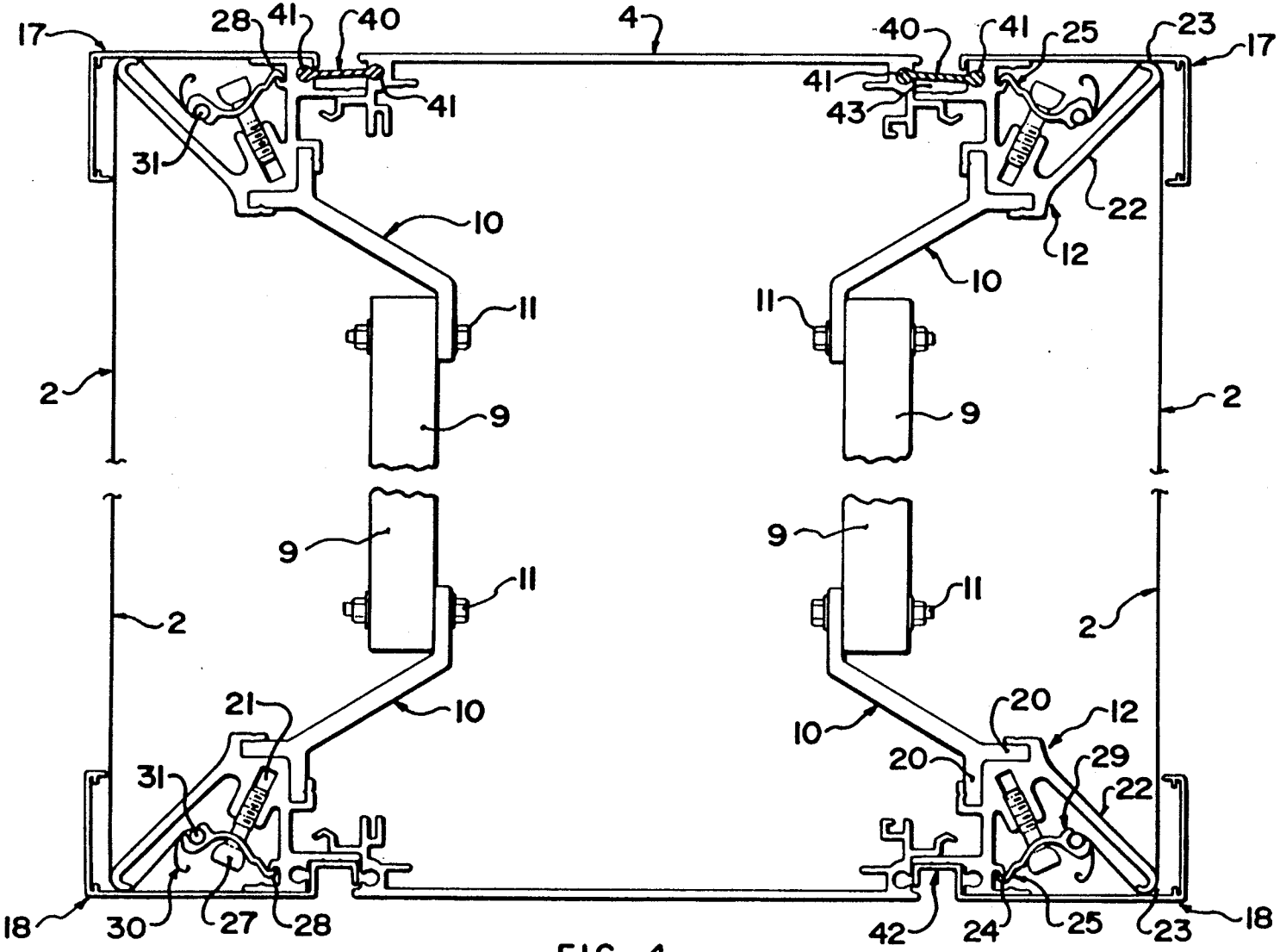
FIG. 4 is a detail of the cross-sectional view shown in FIG. 3*b*.

The sign face tensioning system is best seen in FIG. 4. Frame 12 has channels 20 for receiving the Y-shaped spreader bracket and a continuous screw way 21 for receiving a threaded tension bolt. The frame 12 is readily formed using aluminum extrusion techniques. Frame 12 has an angled face 22 ending in a rounded edge 23. Frame 12 is also provided with a continuous lip 24 which acts as a pivot point for the tension arm 25.

Tension arm 25 is a continuous curved bar provided with holes 26 at spaced locations for receiving tension bolts 27. Tension arm 25 has a flange 28 which cooperates with lip 24 of frame 12 to form a hinge. At the opposite edge from the hinge, the tension arm is provided with a C-shaped groove 29. The end of the flexible sign face material 30 is held in the C-groove by a flexible plastic cylinder or spline 31. The spline is corrugated for better gripping.

The sign face hinge is designated in FIG. 4 by reference numeral 40. It is formed of a flexible plastic extrusion of a material such as that sold under the trademark SANTOPRENE, a polyvinyl chloride which stands up to wide changes in temperature. Hinge 40 is dumbbell-shaped in cross-section having bulbous ends 41 which fit in complementary grooves in frame 12 and filler 4. Top covers 15 or 17 are abbreviated in width compared to bottom covers 16 or 18 in order to expose the hinge 40 and allow the hinge to bend. Bottom covers 16 or 18 have an additional flange 42 which is screwed to frame 12 to secure the sign face in place. In order to allow the sign face to be rotated outwardly away from the cabinet, the screws through flange 42 are removed and the sign face can then rotate about flexible hinge 40. Hinge 40 also serves to cover the groove 43 in the top of the sign and prevents water from accumulating in that groove and freezing. In the embodiment shown in FIG. 2, a ridge 45 is also provided along top cover 15 and this prevents water from dripping down the sign face and causing streaking.

The sign system of the invention is constructed as follows:

The frame pieces 12 and top and bottom covers 15 and 16 (or 17 and 18) are cut to size, the ends being angled at 45°. The spreader brackets 10 are spaced along the length of the frame pieces 12 and are secured on to the frame using screws. Corner pieces are used to fasten the frame pieces 12 at each corner again using screws. Spreader bars 9 are then fastened to the spreader brackets to rigidify the frame.

The vinyl face material is laid out and cut to size so that there is approximately a 6" overlap beyond the edge of the sign face. The design for the vinyl face is applied in the usual manner. Lines parallel to each edge of the vinyl face are drawn for positioning of the spline, and the corners created by the intersecting lines are cut out. The outside edge of the vinyl is folded over along the lines which have been drawn and spline 31 is inserted along the bottom of the fold. Tension arm 25 is then fed along the fold from one end to another by drawing the spline and folded material along the C-shaped groove 28. It is important that the material be configured as shown in FIG. 4. This operation is repeated on all four sides.

The vinyl face is then mounted on the frame by inserting the tension arms along each edge of the vinyl material onto the hinge points 24. Tension bolts 27 are then threaded through the tension arms and into the screw ways 21. Once the bolts have been threaded loosely on all four sides, starting at the centre of each side, the bolts are tightened until the vinyl face is taut and wrinkle-free. Once the face material has been tensioned to the desired degree, the covers 15, 16, 17 or 18 are secured onto the frame using screws. It is important that the top cover be appropriately positioned to allow the installation of the hinge.

The sign face frame can then be installed on the cabinet. The hinge 40 is inserted continuously along grooves 41 of the frame and filler. The sign face can then be secured along the bottom of the cabinet by one or more screws through the bottom cover at 42.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The embodiments of the invention in which an exclusive property or privilege is claimed are defined as follows:

1. A sign comprising a rigid frame defining a planar opening, a sheet of flexible sign face material extending across said opening, and means for tensioning said sign face material across said frame, said frame comprising:

a) means forming a fulcrum;

b) means for receiving threaded fastening means; and c) an outwardly extended edge around which said material is drawn; and wherein said tensioning means comprises threaded fastening means, and an extended bar having opposed lateral edges and forming a layer between said two lateral edges thereof, and having means along a first lateral edge thereof for securing said material, a surface bearing against said threaded fastening means, a surface bearing against and pivoting about said fulcrum on said frame and an aperture for receiving said threaded fastening means located intermediate said means for securing and said pivoting surface whereby said threaded fastening means is inserted through said extended bar and threaded into said frame thereby drawing said material inwardly towards said frame and around said edge.

2. The sign of claim 1 wherein said fulcrum means comprises a lip extending along said frame and adapted to receive said pivoting surface of said tensioning bar.

3. The sign of claim 1 wherein said frame further comprises channels forming a right angle for receiving a Y-shaped supporting element.

4. The sign of claim 1 wherein said outward edge of said frame is rounded.

5. The sign of claim 1 wherein said extended bar extends substantially the full length of the sign face.

6. The sign of claim 1 wherein said aperture for receiving said threaded fastening means comprises a race extending substantially the full length of said frame.

7. The sign of claim 1 wherein said means for securing said material comprises a C-shaped groove and an extended cylinder adapted to be slidingly received in said groove.

8. The sign of claim 7 wherein said cylinder is longitudinally corrugated.

9. The sign of claim 1 wherein said extended bar extends continuously along substantially the full length of the sign.

10. The sign of claim 9 wherein said sign is a polygon and said tensioning means comprises separate extended bars extending along each side of said sign.

11. The sign of claim 1 further comprising a sign cabinet adapted for supporting said frame, and a hinge joining said cabinet and said frame along an edge thereof and comprising a web of flexible material adapted to be secured along one edge thereof to said frame and the other edge thereof to said cabinet.

12. The sign of claim 11 wherein said hinge is dumbbell shaped in cross-section.

13. The sign of claim 11 wherein said hinge extends continuously along said edge of said cabinet and said frame and is positioned to cover the lengthwise area of intersection of said frame and said cabinet to thereby prevent accumulation of water in said area of intersection.

* * * * *